US005092600A

United States Patent [19]

Ruth, Jr. et al.

[11] Patent Number: 5,092,600

[45] Date of Patent: Mar. 3, 1992

[54] INDOOR-OUTDOOR GOLF COURSE

[75] Inventors: Thomas L. Ruth, Jr.; Donald D. Nissen, both of Barrington; Charles E. Maddox, Jr., St. Charles, all of Ill.

[73] Assignee: Future Golf, Inc., Crystal Lake, Ill.

[21] Appl. No.: 362,351

[22] Filed: Jun. 6, 1989

Related U.S. Application Data

[63] Continuation of Ser. No. 069,852, Jul. 6, 1987, abandoned.

[51] Int. Cl.[5] ..... A63B 69/36; A63B 67/02

[52] U.S. Cl. ..... 273/176 A; 273/35 B

[58] Field of Search ..... 273/176 R, 176 A, 176 AA, 273/176 BB, 35 B, 32 R, 178 B, 245, 277; D 21/27

[56] References Cited

U.S. PATENT DOCUMENTS

| | | | |
|---|---|---|---|
| 1,851,423 | 3/1932 | Ely | 273/176 A |
| 2,248,053 | 7/1941 | Bales | 273/176 A |
| 2,490,961 | 12/1949 | Hendry | 273/176 A |
| 3,129,943 | 4/1964 | McKee | 273/176 A |
| 3,350,099 | 10/1967 | Smart | 273/184 R |
| 3,369,812 | 2/1968 | McKee | 273/184 R |
| 3,599,980 | 8/1971 | Harmond et al. | 273/176 A |
| 3,685,832 | 8/1972 | Johnson | 273/176 A |
| 3,860,236 | 1/1975 | Buchanan | 273/35 B |
| 3,904,209 | 9/1975 | Thomas | 273/176 A |
| 4,045,023 | 8/1977 | Heffley, Jr. | 273/176 KX |
| 4,798,385 | 1/1989 | Tegart | 273/176 A |
| 4,941,664 | 7/1990 | Pate | 273/35 B |

FOREIGN PATENT DOCUMENTS

| | | | |
|---|---|---|---|
| 1086566 | 10/1967 | United Kingdom | 273/176 A |
| 1249877 | 10/1971 | United Kingdom | 273/176 A |
| 2163660 | 3/1986 | United Kingdom | 273/176 A |

*Primary Examiner*—Edward M. Coven
*Assistant Examiner*—Sebastiano Passaniti
*Attorney, Agent, or Firm*—Charles F. Meroni, Jr.

[57] ABSTRACT

In an indoor-outdoor golf game layout comprising a building providing a building enclosure therein. A putting area within the building enclosure having putting cups therein for receiving golf balls. A series of golf ball hitting stalls positioned at an outer edge of one side of the building enclosure which stalls protectively isolate the golfers therein and with each of the stalls having a golf ball hitting area therein adjacent the putting area. An uncovered outdoor fairway area located outside of the building enclosure extending away from the golf ball hitting area. The fairway area is so positioned relative to the golf ball hitting area in the building enclosure that golf balls may be hit from an outer edge of the building enclosure onto the fairway area from the golf ball hitting area. A series of golf fairway greens are situated along opposite sides of the fairway area to collectively provide an uninterrupted series of distinct fairway greens effectively positioned generally in end-to-end coinciding relation and extending from the fairway green in closest relation to the golf ball hitting stalls to the fairway green most remote from the golf ball hitting stalls, thus providing a fairway green that can be matched with a player's drive onto the fairway that will match up with a given hole on a player's score card to enable holes of varying yardage to be played off of any given score card being used by golf players.

20 Claims, 5 Drawing Sheets

INDOOR-OUTDOOR GOLF COURSE

This application is a continuation of application Ser. No. 07/069,852, filed July 06, 1987, now abandoned.

BACKGROUND OF THE INVENTION

1. Field of the Invention

The present invention is concerned with a new and improved indoor-outdoor golf game layout where the game can be played from inside of a weather protected clubhouse in such a way that golfers can hit all of the shots regularly executed in an outdoor golf game from an indoor location while creating the impression for the golfer that the game is being played outdoors under normal summer conditions.

The present invention more particularly concerns a new and improved indoor-outdoor golf game layout comprising a covered area or clubhouse with a series of stalls about the periphery where the stalls can be optionally protected by an "air screen" so that a golfer can drive shots from the stalls to outdoor fairways, greens, and sand traps. Basically this invention concerns an indoor-outdoor golf course which includes a building having a putting green in it, along with sand traps, tees, and supporting facilities. Opposite the tees on the outside of the building are fairways and fairway located greens and various kinds of hazards including sand traps and water holes. The game may be played by the player standing on the tee and hitting his ball off of the tee through an air curtain located at one side of the building between the tees and the outside greens. We note that if the player hits off of the tee and the ball goes into a hazard such as the sand trap, then the player takes another ball and drops it into the sand trap located inside of the building and the shot is then played from there to a green or onto the fairway that is located just outside of the air curtain. Unique rules for playing the game and a special score card has been developed to assist players in golf play. The greens can be heated in the winter season so that the snow can be caused to melt off of the greens for year around golf play.

2. Description of the Prior Art

Heretofore, various golf games have been proposed for use other than the so-called regulation golf course that is in common use in many parts of the world today. Examples of such previously known golf games are disclosed in the following U.S. Patents:

| Patent No. | Patentee |
|---|---|
| 3,104,879 | J. Jetton |
| 3,464,703 | T. L. Vallas |
| 3,501,152 | R. M. Conklin et al |
| 3,712,624 | Robert M. Conklin |
| 3,861,680 | William F. Mowrer |
| 3,904,209 | Clarence A. Thomas |
| 4,045,023 | Russell M. Heffley, Jr. |
| 4,572,512 | Harold G. Tegart |

U.S. Pat. No. 3,464,703 issued to T. L. Vallas appears to be one of the most pertinent patents among those listed above. This patent contemplates an indoor-outdoor golf game, and provides a building where indoor tees are located. An air screen is located on one wall of the building and the tees are located relative to the air screen so that a player can drive his ball through the air screen to distant greens. The greens are on the outside of the building, and they are provided with different types of hazards including sand traps are the like. Additional greens 130*c* and located in close adjacency to the air screen so that if a tee shot is hit into one of the distant greens, such as at 45, the player can then drop another ball into the sand trap area to 10 located inside of the building and he can then hit the ball from there to the adjacent greens as indicated at 130*a*, 130*b*, and 130*c*. The patentee also refers to the use of an "air screen" and states that the golf ball is driven through the air screen into the fairway from the driving and sand trap areas.

U.S. Pat. No. 3,861,680 also contemplates the use of an air curtain for use with a driving range so that a player can drive golf balls from indoor tees through the air curtain to practice his game.

SUMMARY OF THE INVENTION

In an indoor-outdoor golf game layout comprising a building providing a building enclosure therein, a putting area within said building enclosure having holes therein simulating putting cups for receiving golf balls, at least one golf ball hitting stall positioned at an outer edge of one side of the building enclosure protectively isolates the golfers therein and with the stall having a golf ball hitting area therein adjacent said putting area; an uncovered outdoor fairway area outside of said building enclosure extending away from said golf ball hitting area, said fairway area being so positioned relative to said golf ball hitting area in said building enclosure that golf balls may be hit onto said fairway area from said golf ball hitting area; and a series of golf fairway greens on opposite sides of said fairway area effectively positioned in end-to-end connected relation along said fairway area providing a succession of golf green targets at approximate distances of 1 to 275 yards from said hitting area.

According to other features of our invention, the greens are staggered in random relation on opposite sides of the fairway extending away from the golf ball driving area with some of the golf greens being positioned on one side of the fairway, and with other of the golf greens being positioned on the other side of the fairway, but with all of the golf greens being effectively disposed in end-to-end relationship thus affording the golfer every possible shot to a green up to 275 yards.

According to still other features of our invention, indoor and outdoor sand trap areas are positioned at opposite sides of the putting area, a golf green is also positioned outside of the enclosed covered area at each side of the enclosed area but immediately adjacent to the trap areas enabling a golfer to shoot from the trap from inside of the enclosed covered area to the golf green positioned outside of the enclosed covered area, the sand traps being located away from the golf ball driving area, and protective nets extending diagonally away from opposite corners of the enclosed covered area, thus segregating the sand trap areas from the fairway area to minimize the possibility of injury to golfers.

BRIEF DESCRIPTION OF THE DRAWINGS

Further features, objects and advantages of the invention will be found throughout the following more detailed description which refers to the accompanying drawing, wherein.

DESCRIPTION OF THE PREFERRED EMBODIMENTS

Figure 1:
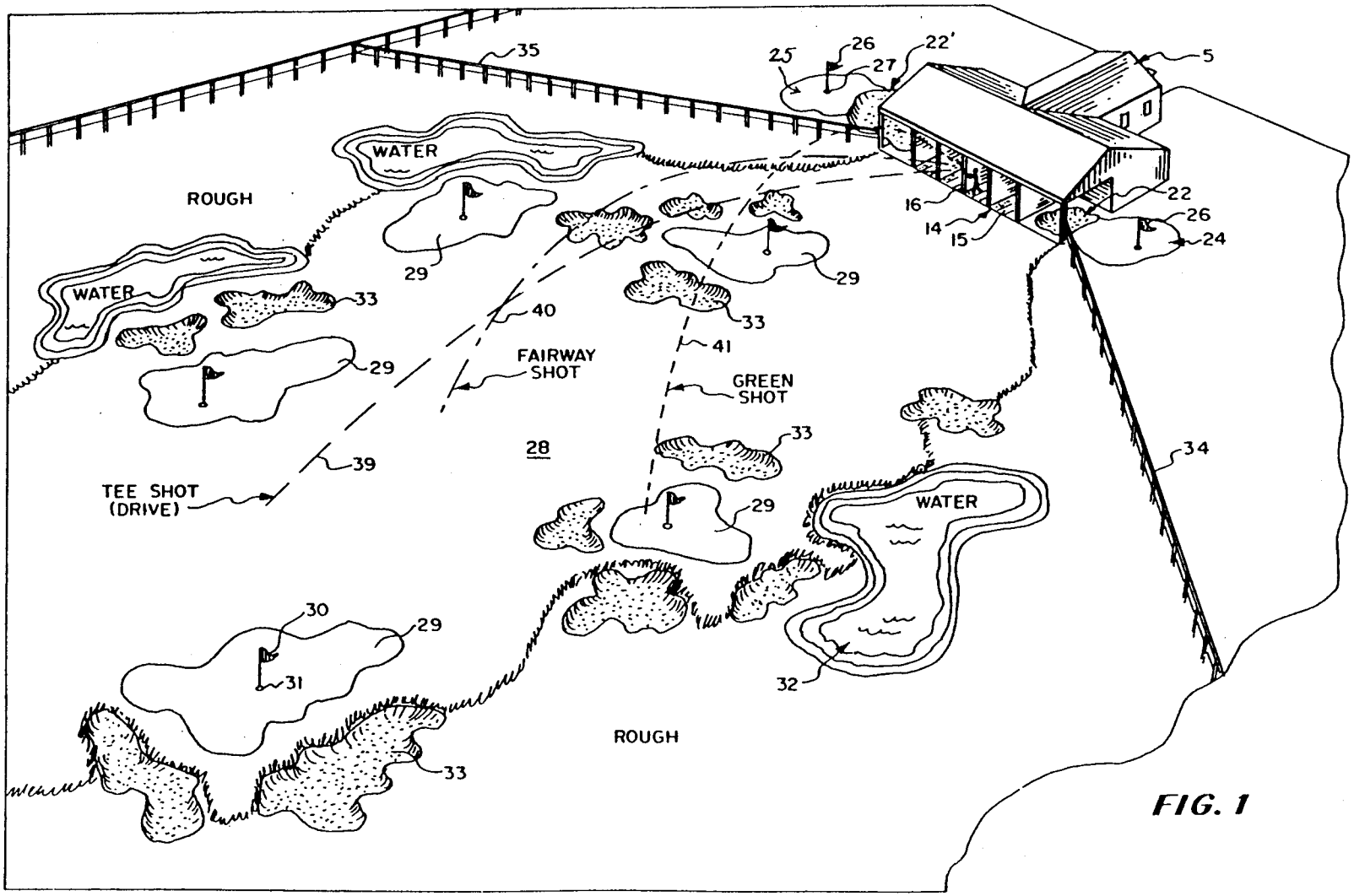
FIG. 1 is an enlarged fragmentary perspective view of an indoor-outdoor golf game layout embodying important principals of our invention.

The reference numeral 4 indicates generally an indoor-outdoor golf game. The golf game includes a clubhouse 5 with an entry 6 therein. The clubhouse may also be provided with a food service area 7, and bathrooms 8 and 9. Beyond the entry are interior walls 11, 11 which serve to divide up the golfing area 10. On one side of the interior walls 11, 11 are a pair of putting greens 12 and 13. These putting greens may be covered with an artificial covering so that players can chip shots onto an artificially surfaced green, or so that the players can putt on the green all in a way that simulates outdoor playing conditions as will be explained in further detail hereafter.

Figure 7:
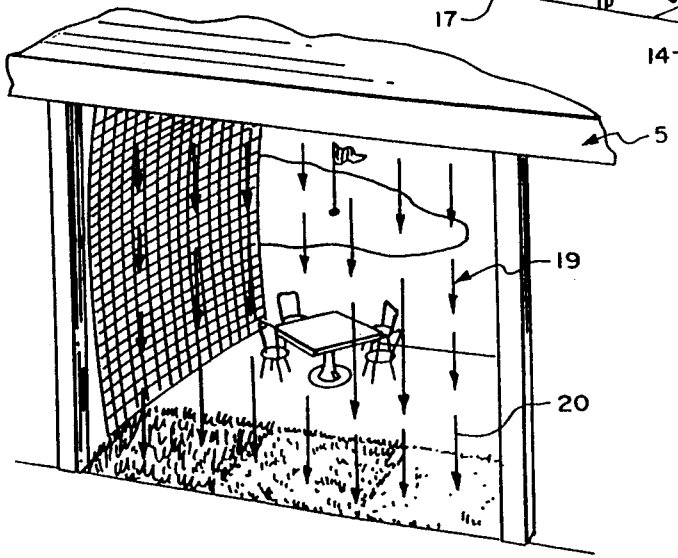
FIG. 7 is an enlarged fragmentary view of a golf hitting area of the clubhouse with the arrows denoting an "air screen"

Provided on the other side of the interior walls 11, 11 is a golf ball driving area 14. The area 14 includes a series of side-by-side golf ball hitting areas 15. The term "golf ball hitting area" where ever used is intended to identify where a golfer can hit any one of a number of golf shots from different types of grass surfaces including tee shots, rough shots, fairway shots and the like. The stalls are divided from one another by stall walls 16 and can be covered by protective nets if needed to protectively enclose each stall from all other stalls except at the "air screen" side as will be further described hereafter. Interiorly of each golf ball hitting areas are a series of golf tees 17. These tees can be of varying types with tee areas that will simulate different outdoor playing conditions including "rough", "fairway turf" and a golf driving area as shown in FIG. 7 where different types of artificial turf is illustrated. The golf ball hitting areas 15 are uniquely configurated insofar as each stall is totally segregated from adjacent stalls so that any golf activity carried on by a golfer in one stall will be totally private thereby preventing the possibility of anyone else to be injured as a result of a person swinging a golf club in an adjacent stall or as a result of a golfer hitting a golf ball in an adjacent stall. Since it is contemplated that a series of foursomes will be simultaneously playing the golf game in individual golf ball hitting areas, it is absolutely necessary to take whatever steps are necessary to protect the safety of all of the golfers that may be using the total facility.

The golf ball hitting areas are also provided with tables and chairs 18 so that golfers can have an area for scoring, resting, and for refreshments. The interior of the golfhouse 5 has been laid out so that it will be easy for the golfers to move about inside of the clubhouse to use the facilities and to transport food back and forth from the food service area to the golf ball hitting area.

The clubhouse 5, at the area of the tee stalls, is provided with an "air screen" area 19. This area is comprised of a series of individual air screens 20. Each of the air screens 20 provides a closure for a stall 15 so that the golfer will be sheltered from the weather occurring on the outside of the clubhouse 5 while engaged in a golf game from the inside thereof. The air screens can be of a construction as is already shown in the prior art. When the clubhouse is to be closed at the end of each golf day, the clubhouse 5 is also provided with conventional types of sliding stall closure doors 21, which can be moved from an overhead position and which can serve as a security closure to close the outside of the clubhouse 5 at the area of the tee stalls so that the air screens 20 can be shut off and the clubhouse can be thereby secured against unauthorized or illegal entry when the premises are left unoccupied.

It further will be seen that the clubhouse 5 is provided with a totally enclosed inside sand trap 22 and an indoor-outdoor sand trap 23. The traps are isolated in individual sand trap stall areas 22' and 23' to protect other golfers from the golfers swinging and hitting the ball from these traps. Here again, the air screens 20 and sliding closure doors 21 can be used to shield the interior of the clubhouse from the weather elements and also to close down the clubhouse as previously described.

Figure 4:
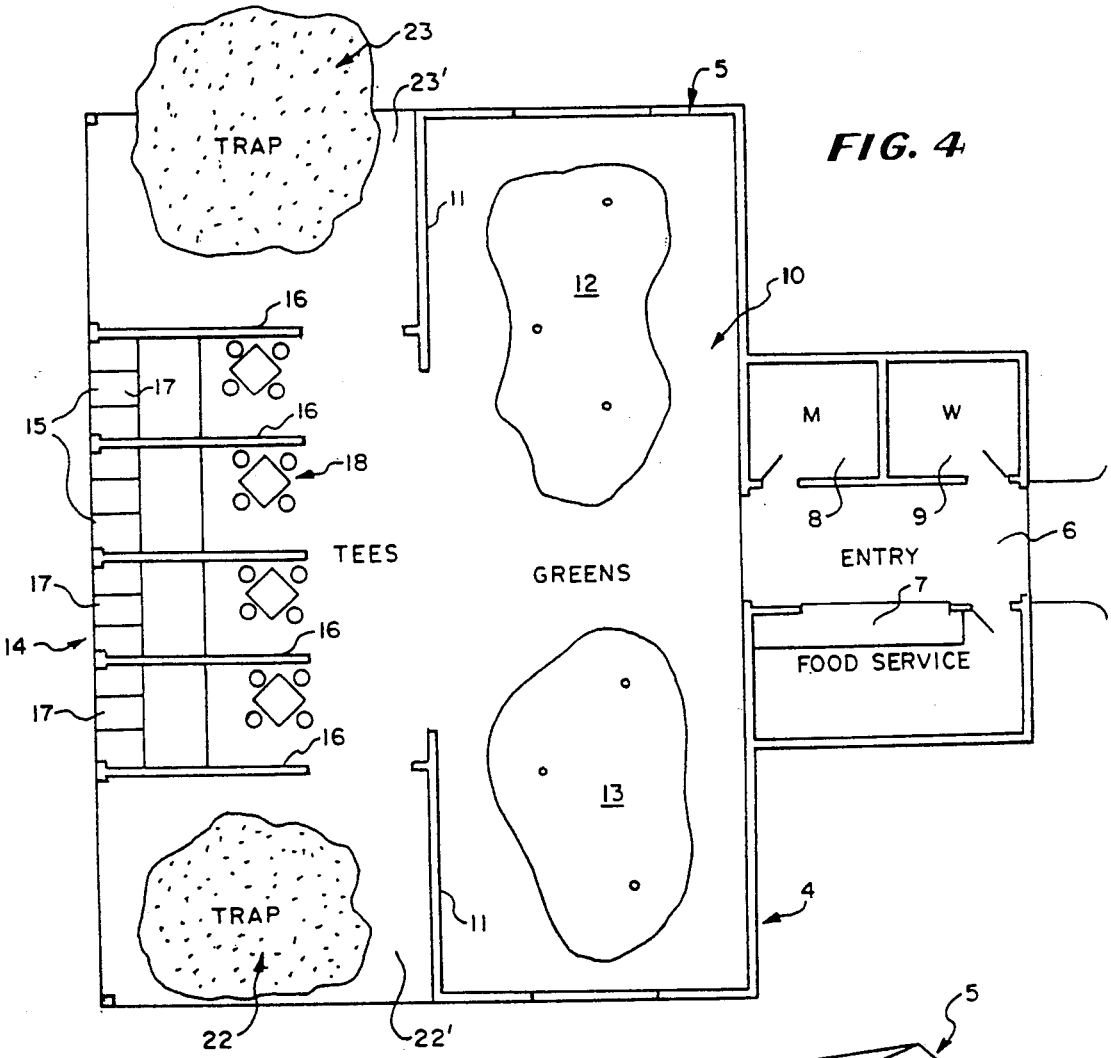
FIG. 4 is a top plan layout of the clubhouse shown in FIG. 3 only with the roof removed and with the legends applied to identify different play and service areas within the clubhouse.
Figure 5:
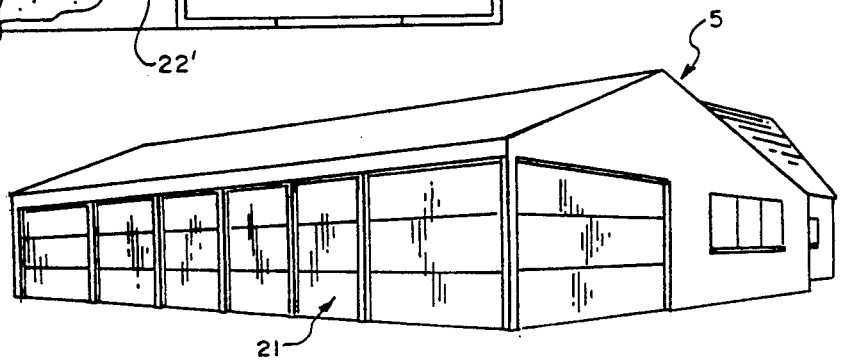
FIG. 5 is a perspective view of the clubhouse only showing the clubhouse "shut-down" and with security doors in place to prevent illegal entry.
Figure 6:
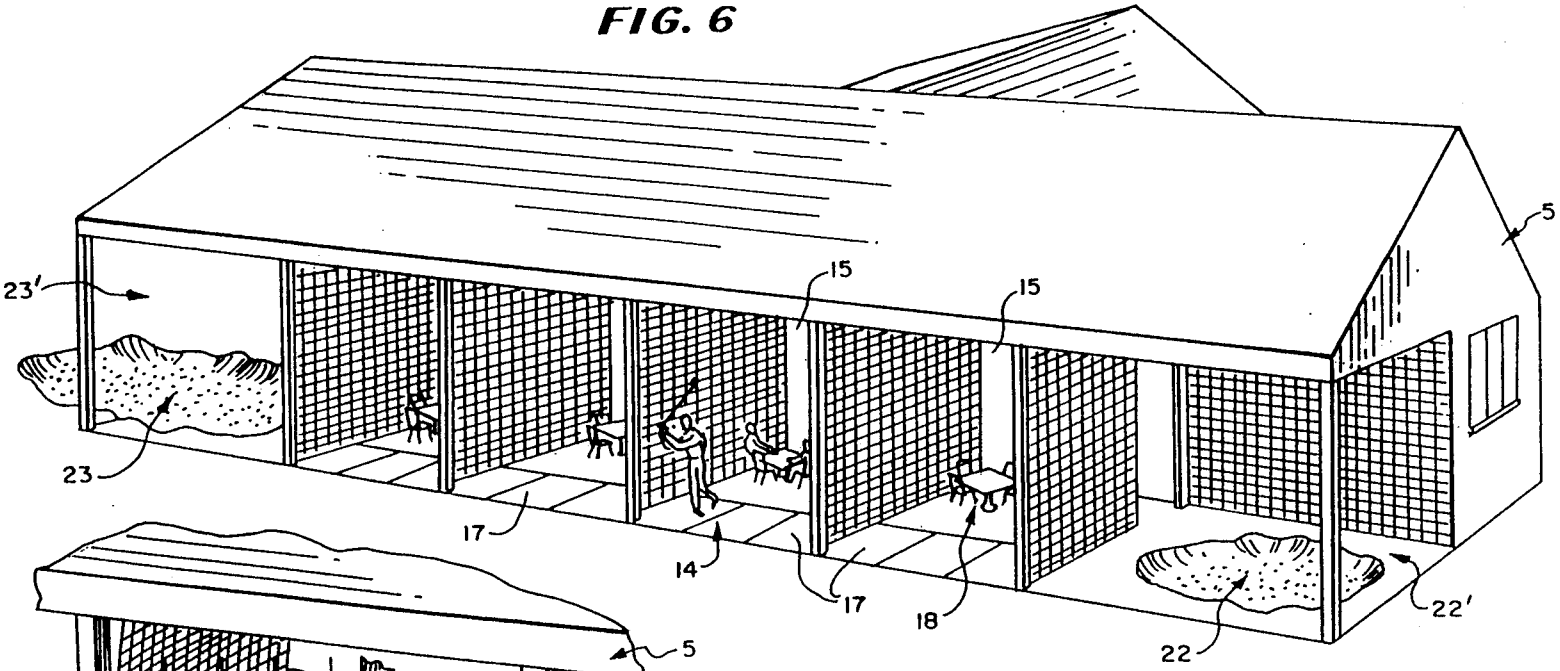
FIG. 6 is an enlarged perspective view of the clubhouse showing the overhead sliding doors removed and illustrating the way in which the indoor-outdoor golf game layout appears from an outside viewing vantage point of the clubhouse.
Figure 8:
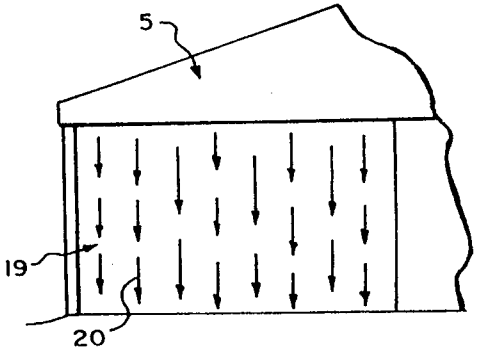
FIG. 8 is an enlarged fragmentary diagramatic view of an end of the clubhouse showing a sand trap stall and with the arrows denoting an "air screen" through which a golfer may hit a golf ball.

Referring now to FIG. 4, it will be seen how the one trap 22 lies within the clubhouse and how the trap 23 is partially inside and partially outside of the clubhouse. The way in which these traps are used is for the golfer to stand in the trap and strike his ball in a direction towards the golf greens 24 and 25 or the fairway in the one instance and in the other instance from within the sand trap stalls 22' and 23'. It will thus be seen that golfers will use the golf tee area or golf ball hitting area 14, and will also use the sand traps 22 and 23 at the same time. Since the golfers in the sand traps 22 and 23 are also isolated in sand trap stalls 22' and 23', and are hitting the balls at the opposite sides of the building at right angles away from the direction where the golfers are hitting from the tees 17, there will be little or no possibility of anyone being injured as a result of golf shots being simultaneously hit from the various golfing areas inside of the clubhouse. It will also be seen that outdoor protective screens or nets 34 and 35 are provided to insure that golf shots cannot stray into the different playing areas and possibly injure any golfers should any of them improperly leave the clubhouse or the enclosed area and stray into these outside playing areas. These nets or fences 34 and 35 can also prevent golfers after walking outside of the clubhouse into different areas of golf play outside the clubhouse.

As it will be observed, the golfers striking the balls out of the sand traps 22 and 23 will be aiming for the side golf greens 24 and 25 or onto the fairway. The greens 24 and 25 are provided with flags or flag pins 26 and putting cups 27, so that the golfer will have the opportunity for their shots to be aimed at the pins 26 and have the possibility for the ball to roll into the cups 27 associated therewith.

Now in the play of the golf game, it will be seen that opposite the golf ball hitting area 14 is located a fairway 28 which may have natural or artificial turf as desired. It is not contemplated that the golfers will strike balls from the outdoors since the golf game is played exclusively from the indoor enclosed area of the clubhouse fairway 28. As a result of the orientation of the playing stalls in the clubhouse with the outdoor traps, fairway, rough and greens, the player is standing in the golf ball hitting area and when looking out at the fairway he will be given the mental impression that he is playing golf on a regular outdoor golf facility only from an indoor location which embodies important features of our invention.

Figure 2:
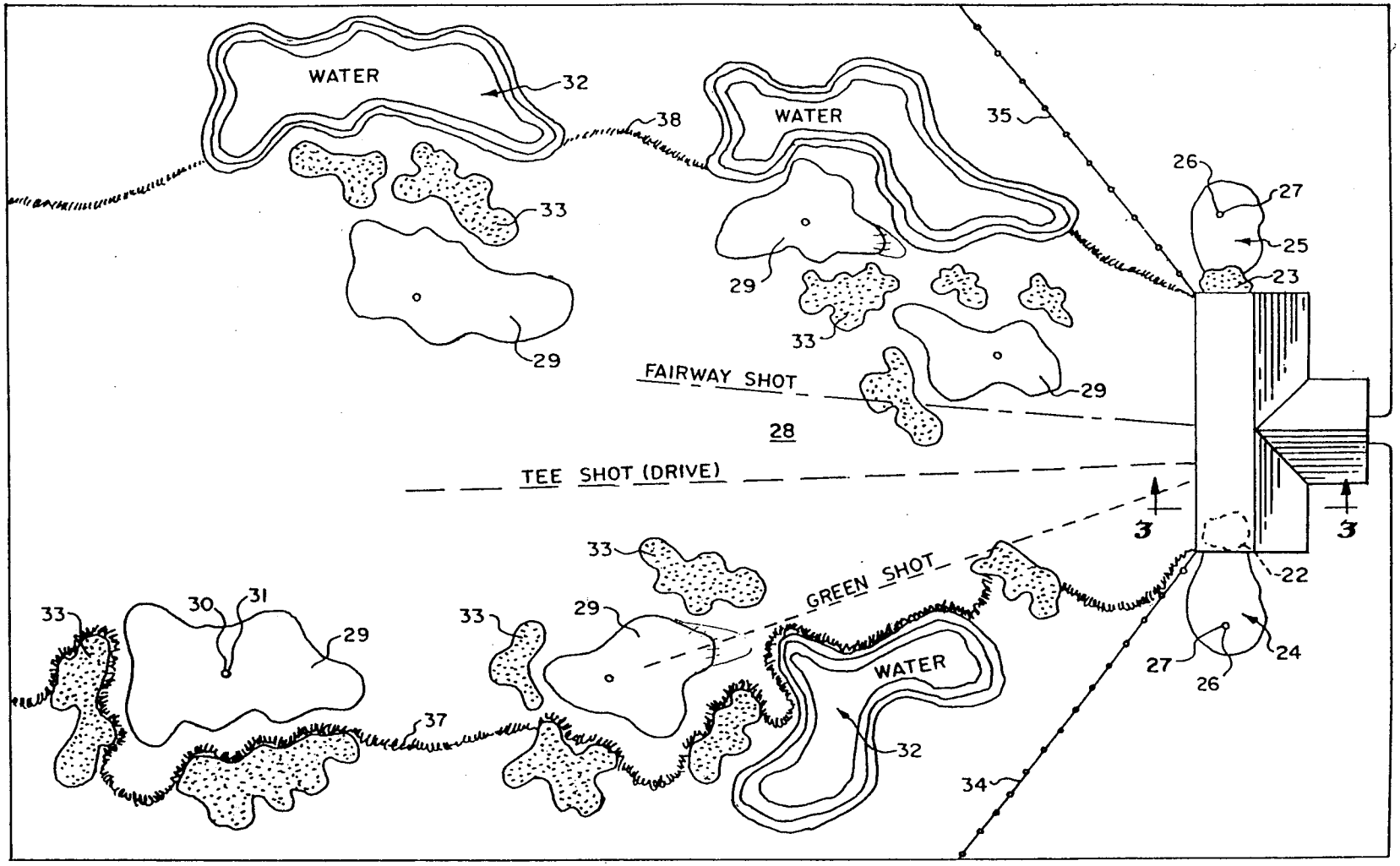
FIG. 2 is a enlarged top plan view of the indoor-outdoor golf game layout shown in FIG. 1.
Figure 3:
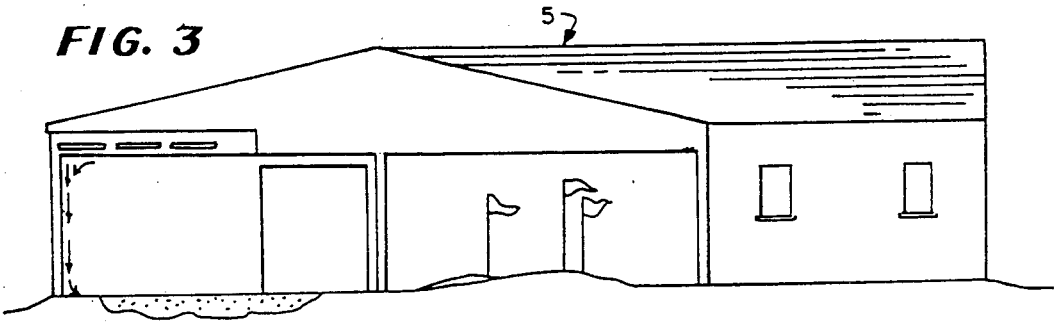
FIG. 3 is a fragmentary end perspective view of the clubhouse as viewed on the line 3—3 looking in the direction indicated by the arrows as seen in FIG. 2.

From a consideration of FIG. 2, it will be seen that the golfer can drive his tee shot or his fairway shot from the golf ball driving area 14 or he can hit his shot from the tee stall 15 directly to a green in accordance with the rules of the game. It will further be observed that the staggered greens 29 are located on opposite sides of the fairway 28. Located on the greens 29 are flags or flag pins 30 and putting cups 31. The surface of the green can be comprised of an artificial turf or a conventional type as previously described. These greens are laid out in such a way that the greens 29 are positioned in lapping relationship so that the closest green with reference to the golf ball driving area will lap the next closest green and the next closest green is then positioned in lapped relation to each other green in succession out to the furtherest green from the clubhouse 5 in accordance with other important features of our invention. Now in addition, the fairway 28 has fairway hazards 32 including sand traps 33 or bunkers. The fairway hazards may also include water hazards or blue colored sand to simulate water hazards as depicted in the drawings including FIG. 2. On the opposite sides of the fairway 28 beyond the greens and trap is a so-called "rough" or rough area, which has been identified by the legend "rough". It will further be seen that the rough line between the "fairway" and the "rough" has been marked with the identification numbers 37 and 38 (FIG. 2) along opposite sides of the fairway. If a golfer strikes a ball from the tee that lands in the "rough" his next shot from the stall can be from the so-called "rough" simulating artificial turf in the golf ball hitting areas to one of the greens in accordance with the game rules hereafter described. For identification purposes dotted lines and legends are shown on FIG. 1 at 39 to identify a typical "tee" shot or a "drive", at 40 to show typical "fairway" shot, and 41 to show a typical "green shot".

The following sections entitled "Building" and "Golf Course" set forth additional ideas we have developed for use in connection with this patent disclosure

BUILDING

1. The playing booth has an air door and may be approximately 12' wide and 15' high. The depth is sufficient so 3 players can relax while another one of them is striking the ball. The stall provides privacy and has netting so errant shots can be caught. Another purpose of the stall is to isolate the players to give them a feeling of being alone on a golf course.
2. The nets and/or fences extends diagonally from opposite corners of the clubhouse from one side of the building. The nets or fences can function to confine so-called "hooks" and "slices" for confining the hit balls in the playing area. Also by moving from one stall of the building to the other, the approach shots to the greens will be changed affording different shots to the green.
3. The mats (area for hitting ball) must be as close as possible to the air curtain so that when hitting the ball, the golfer has the feeling of not being in a building but in open space.
4. The sand area is on each end of the building and provides a deep sand shot in one and a shallow sand shot in the other. The air curtain door can be preferably located in front and on the side so that the golfer can hit a fairway sand bunker shot or a green bunker shot.
5. The building can be angled and provided with diverging wings containing the golf ball hitting areas, if desired.
6. The outside and inside greens are artificial-similar to "omingreen"$^R$
7. Certain of the greens allow short approach shots, chips and wedge shots. The interior greens can be changed as to contour and hole placement to vary position shots from time to time.
8. Nine holes can be played from one stall and the back nine can be played from another stall thereby enabling different types of shots to be executed to differently appearing holes to simulate an outside or outdoor golf course.
9. There is "frog hair" grass around interior green to allow short chips, etc.

GOLF COURSE

1. The golf course may be preferably laid out on a 300×150 yd. site.
2. The golf course is constructed in the same manner as a regulation course and may have distance markers along the "fairway" and/or the "rough" to assist the golfer in determining the yardage for the golf shots that have been hit by players in his or her foursome from the booth or stall.
3. The building where the golfer strikes the ball is elevated to assist in seeing ball light (hit green) and determining distances.
4. The green on each side alternate in size, and so that were one ends the green on the other side begins. This provides the golfer with distance to the holes of 275 yards to 1 yard.
5. The greens are banked so the far side of the green is higher than the front. The greens are constructed like regulation greens. The greens can be natural or aritifical (a sand dyed green). The greens will be heated by electric heating pads (as used on dirveways, etc) and will have a sensing pad so that when a ball strikes the green its position will be shown on a screen in the booth. When shooting to No. 4 green, the golfer can turn on No. 4 monitor shooting to No. 4 green turn on No. 4 monitor.
6. The greens will have the holes at distances of determined length and the size of the green will be shown so distances can be calculated with these and other landmarks (much as is done on a "pro's card"150 yard marker etc.) Also the fairway grass will be mowed so that each 20 yards is of a different shade of green to further assist in determining distances.

7. Water hazards may be natural or blue sand.
8. Sand hazards and water hazards can be modified and changed for variation.

PLAY OF THE GAME

It is now contemplated that the greens will closely simulate regulation greens. They are preferably banked so that when a shot is hit to them, there will be a tendency for the ball to hold its position on the green. It is also preferred if the greens are sand surfaced so that the ball will further hold its position when it strikes the green and not bounce off the green.

There also will be other types of greens natural grass or artificial grass in addition to the sand greens. The indoor greens will be artificial grass that is the same texture of a grass green and can be modified so a putt will be slow or fast, and will be adapted so that the player can chip shot onto the aritificially surfaced green, or so that he can putt on the artificially surface green after he arrives there.

The indoor golf green can be made out of a suitable synthetic material of such a character that the pin placements on the green can be changed by redrilling and plugging the holes as is the case with a regular outdoor green. Still further, the putting characteristic of the green can be varied as much as with a regulation outdoor green by the sprinkling of sand onto the synthetic carpet whereby more "slippery" greens can be created and the putting characteristics can be varied from hole to hole much as can be found on a regulation golf course. The contour of the inside green can also be modified.

Figure 9:
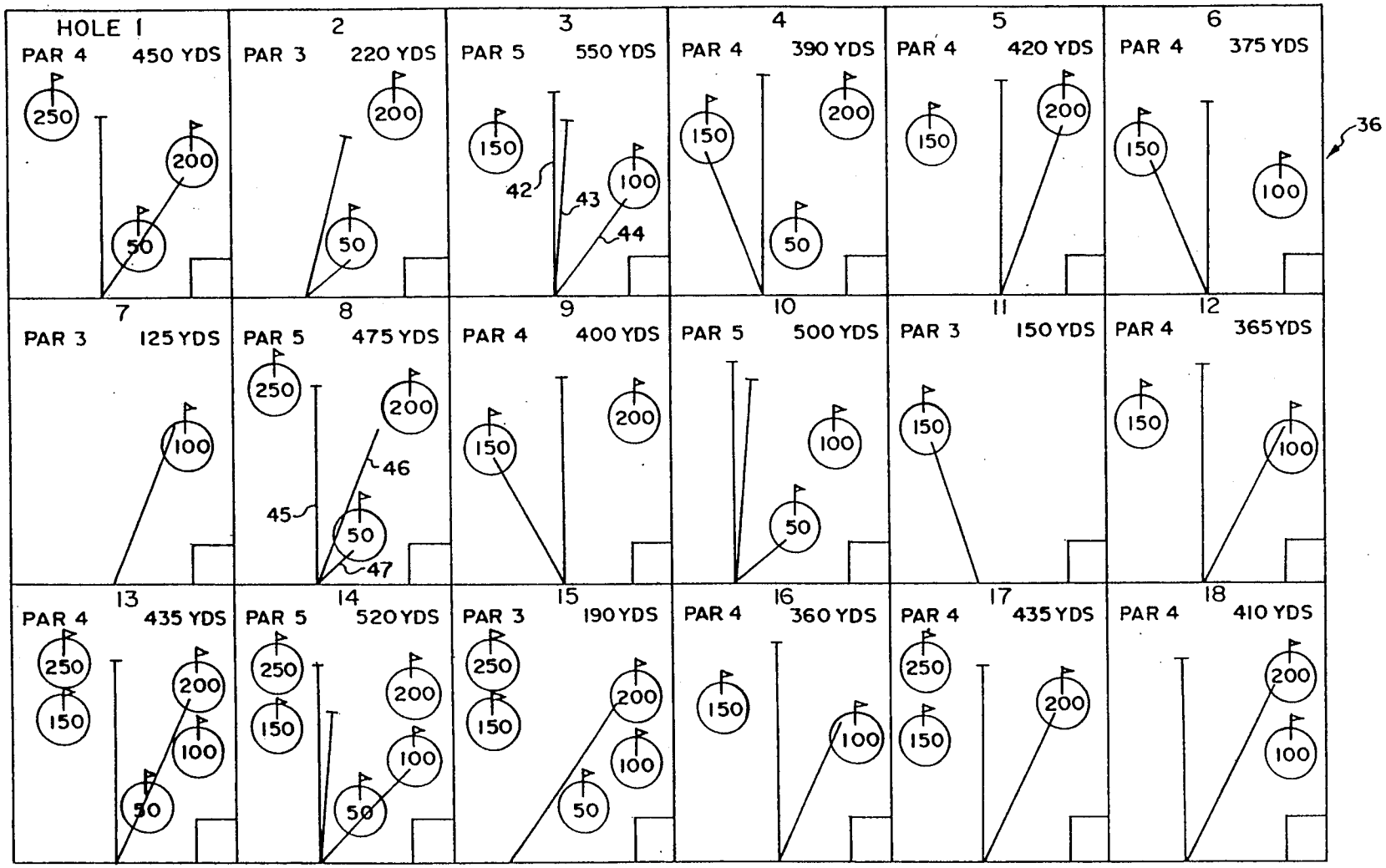
FIG. 9 is a diagramatic plan layout of a score card or a portion of a score card showing the layout for an eighteen hole golf game that can be played by a golfer using our indoor-outdoor golf game layout herein disclosed.

In order to play the game, the golfer looks at the score card 36 (FIG. 9) and when he is playing "Hole 3", he will first take a tee shot 42 from the tee a distance such as 250 yards to a distant target or green area which comprises a simulated golf green having a golf pin on it. The drive may be one that is hit to the fairway when the shot is properly made rather than to the green if the first hold is laid out on the golf card in such a way as to comprise a 450 yard hole. After striking the first shot, which we will say lands in the middle of the fairway 250 from the tee, then there is a second or fairway shot 43 that must be made from the so-called middle of the fairway. This shot is made from the same tee as the first shot was made, but from a different section of the tee where "fairway" turf is simulated as stated before. These tees are built in such a way that they have an artificial surface which has different layers to create different lies so that one lie will simulate a tee shot, another lie will simulate a lie that a golfer would have for a fairway shot, and still another lie will simulate a so-called "rough lie". A golfer will strike his third shot 44 to the green that he believes most closely approximates the distance that his shot must travel to complete the 450 yard hole. Then if the ball hits the green, he then goes into the green area within the building and putts out his ball on the green there from the same distance from the golf cup where his ball rested after he had made his shot to the outdoor green, as just described. In this way the requirements of score card 36 are fulfilled as shown on "Hole 3". If the second shot lands in the area which comprises the traps, then he goes into a different part of the building to a so-called sand trap area. These areas 22 and 22' are at the corners of the clubhouse at opposite ends of the tees. The golfer will then take his third shot from either of the trap areas 22 or 22', and strike his ball to the simulated greens 24 or 26 which are located outside of the building within proximity to the sand trap areas just previously described. If he lands on the green, then he will go to the green area within the clubhouse and putt out the hole in the same way as he would on a regulation golf course. To determine the nature of the putt that the player must make, after he strikes his ball from the sand trap to the green, the golfer then approximately notes the distance of the ball to the pin and he makes a mental note of this distance. The golfer then will walk to the green inside of the building and place his ball on the green a distance which approximates the distance that he has hit the ball to the green from the trap, and then putt the ball from that position to the cup.

If the golfing foursome has reached "Hole 8", as an example, the hole can be played in much the same way as any of the other holes as has already been described. For purposes of illustration, it will be noted that on "Hole 8" the golfer must first strike a tee about 45 and after he does so let say that the ball lands in the middle of a fairway to 250 yards from the hole. The golfer then refers to the golf card and sees that the hole is 475 yards. He then makes the mental determination that he has 225 yards to reach the green. The golfer then aims for one of the greens which are located a distance of 225 yards from the tee and strikes a fairway shot as indicated at 46. The shot may only travel 175 yards. The golfer then makes the mental determination that 175 yards plus 250 yards totals 425 yard leaving the golfer with 50 yards remaining to the green. The golfer then strikes his third shot 47 to a green which is located some 50 yards from the tee and let us assume that the ball strikes the green. The golfer then has fulfilled the requirements of "Hole 8" on the score card 36, and then goes t the green inside the clubhouse and places another ball a distance from the flag and cup approximating the distance where his ball was hit to after he executed his shot indicated at 47 on "Hole 8". The golfer putts out the hole and totals his scores and writes his score onto his score card. The golfer may handicap himself in the same way as handicaps are computed on a regulation golf course.

The green outside of the building along the fairway all have flags and there are approximately five flags shown. The position of each of the flags is known. There is a graph that the golfer can refer to so that he knows the exact distance of the tee to each of the flags. This is important for the golfer so that when he hits his tee shot or his unsuccessful second shot, he can approximate the distance that he has hit the ball so that he can make a third shot for the green. For example, if the first shot is hit a distance of 150 yards on a 450 yard and then a second shot is hit a distance of 200 yards, then the golfer can calculate that he has 100 yards left for his third shot. He will then make his third shot. Hopefully the third shot will land on the green, but if not then in the trap and he will go through the same steps as previously described.

The player then will continue to play the next hole from the same booth and also from the same golf ball hitting area. The same layout can be basically used to generate a so-called "front nine" and then a so-called "back nine". This is important so that a golfer may have the feeling that he has different layouts for his golf outing on each nine. The way that this effect can be created is for the golfer to move from one inside golf ball hitting area or tee booth to another one and for example the first tee area might be located at one end of the overall tee area and then the golfer can go to a second tee position at the other end of the other so-called golf ball hitting area and play nine holes from that position and have a different layout than what he experienced when addressing and striking the ball from the first tee area used to play the first nine. The design of the golf course could be that on the front nine, the greens are open whereas on the back nine, the opening of the greens would be over water and sand traps by moving from one booth to another booth.

It is contemplated that four players will play like a foursome on a normal course. The first player will step up on the tee and hit his tee shot and then the second player etc. until all the tee shots have been hit. Each player will record his shot or the distance of his shot on a score card. After the first shots have been made the players in the foursome then will make their second shots and continue play as a foursome until the ball is holed out inside the building at the green area. Then the golfers will play the second hole so to speak and repeat the process until nine holes has been completed. After nine holes have been completed, then a different tee position will be used as previously noted and the foursome will then play the so-called back nine from the different tee positions in the same way that the first nine was played.

Preliminary tests on a simulated course have established that a golf round can be completed in about two hours. The reason for this speed up is that there are no lost balls and there is no travel time between tees and no waiting so the whole game of golf can be completed quickly. This is an important advantage of our layout.

This golf game is played entirely within the clubhouse. Each booth accommodates four golfers. Each golfer will in turn use the hitting area which is in three sections, (1) a golf ball hitting area, (2) "fairway" area and (3) a "rough" area. Each golf shot is struck from one of these areas through the air curtain and onto the outside fairway or green. The first will be from the tee. On par three the target will be a designated green. On par four and five holes, the second and third shot will be from the fairway area of the hitting area to a designated green. By determining the distance to his drive and/or fairway shot, the golfer can determine the distance of the green and shoot for that particular green. Once on the green, the golfer will putt out on the inside green behind the booth. After putting out the golfer returns to the same booth and plays the next hole. After a golfer plays nine holes, he moves to another booth on the opposite side of the clubhouse to play the "back nine". Sand shots are played from the sand shot booths on each end of the building. For chip shots 10 to 35 yards used the fringe on trap and shoot the trap green.

For chip shots less than 10 yards, use the fringe area on the inside putting green. All other golf shots are played from the booth out to the golf course.

All greens are 50 yards in depth and the flag on each green is in the center of the green.

| | | |
|---|---|---|
| Front of green 25 yards | White flag is 50 yards | Back of green 75 yards |
| Front of green 75 yards | Red flag is 100 yards | Back of green 125 yards |
| Front of green 125 yards | Black flag is 150 yards | Back of green 175 yards |
| Front of green 175 yards | Orange flag is 200 yards | Back of green 225 yards |
| Front of green 225 yards | Green flag is 250 yards | Back of green 275 yards |

(The depths and yardage of greens may be modified or varied.)

For trap shots, if ball flies into trap it is a "fried egg" lie. If the ball rolls into trap it is sitting up. The trap on right side of the clubhouse is a deep trap. The trap on left side of the clubhouse is shallow. It is the golfer's option as to which trap to use. All fairway traps are shallow traps. If the golfer hits a shot and the ball goes into any sand trap, (green traps included) the next shot is played as a fairway trap shot.

It will be appreciated that different score cards 36 can be used in connection with the golf play of the golf game by a golfer. For example, a golfer could play different so-called famous golf courses such as Pebble Beach, Medina No. 3, etc., on the golf course layout described herein by adapting the golf cards of these other famous course to the indoor-outdoor golf game layout herein described.

We claim:

1. In an indoor-outdoor golf game layout comprising a building providing a building enclosure therein, a putting area within said building enclosure having putting cups therein for receiving golf balls, a series of golf ball hitting stalls positioned at an outer edge of one side of the building enclosure which stalls protectively isolate the golfers therein and with each of the stalls having a golf ball hitting area therein adjacent said putting area; an uncovered outdoor fairway area outside of said building enclosure extending away from said golf ball hitting area, said fairway area being so positioned relative to said golf ball hitting area in said building enclosure that golf balls may be hit from an outer edge of the building enclosure onto said fairway area from said golf ball hitting area; and a series of golf fairway greens along opposite sides of said fairway area to collectively provide an uninterrupted series of distinct fairway greens effectively positioned generally in end-to-end coinciding relation and extending from the fairway green in closest relation to the golf ball hitting stalls to the fairway green most remote from said golf ball hitting stalls, thus providing a fairway green that can be matched with a player's drive onto the fairway that will match up with a given hole on a player's score card to enable holes of varying yardage to be played off of any given score card being used by golf players.

2. The indoor-outdoor golf game layout of claim 1 further characterized by the fairway greens being staggered in random relation on opposite sides of the fairway area and extending away from the golf ball hitting area with some of the fairway greens being positioned on one side of the fairway, and with other of the fairway greens being positioned on the opposite side of the fairway area.

3. The indoor-outdoor golf game layout of claim 1 further characterized by sand trap stalls located at opposite ends of the building enclosure with said golf ball hitting areas lying between the opposite ends, sand trap areas cooperable with the trap stalls and lying at least in part within the building, separate end located golf greens for receiving sand shots from the sand trap areas at opposite ends of the building, the sand traps being remotely located away from the golf ball hitting area thus enabling golfers to hit shots from the sand traps and the golf ball hitting area at the same time in a safe manner, the layout being such as to enable a golfer to play the same golf sand trap shots playable on a regulation outdoor golf course without leaving the building enclosure.

4. In an indoor-outdoor golf game layout comprising a building providing a building enclosure therein, a putting area within said building enclosure having putting cups therein for receiving golf balls, at least one golf ball hitting stall positioned at an outer edge of one side of the building enclosure which stall protectively isolates the golfers therein and with the stall having a golf ball hitting area therein adjacent said putting area; an uncovered outdoor fairway area outside of said building enclosure extending away from said golf ball hitting area, said fairway area being so positioned relative to said golf ball hitting area in said building enclosure that golf balls may be hit from an outer edge of the building enclosure onto said fairway area from said golf ball hitting area; and a series of golf fairway greens staggered on opposite sides of said fairway area and thereby effectively positioned generally in end-to-end relation along said fairway area providing a succession of golf green targets at approximate distances of 1 to 275 yards from said hitting area, sand trap stalls at opposite ends of the building enclosure with said golf ball hitting areas lying between the opposite ends, end greens facing opposite ends of the building, sand trap areas cooperable with the trap stalls enabling golfers to hit shots to the end greens, at least one of the trap stalls having two trap openings for enabling the golfer to selectively shoot sand shots either to one of the fairway greens or to said end green spaced from an end of the building opposite the associated trap stall, the sand traps being located away from the golf ball hitting area, thus enabling golfers to hit shots from the sand traps and the golf ball hitting area at the same time in a safe manner, the layout being such as to enable a golfer to play the same golf sand trap shots playable on a regulation outdoor golf course without leaving the building enclosure.

5. The indoor-outdoor golf game layout of claim 4 further characterized by the fairway greens being staggered in random relation on opposite sides of the fairway area and extending away from the golf ball hitting area with some of the fairway greens being positioned on one side of the fairway, and with other of the fairway greens being positioned on the other side of the fairway area, but with all of the golf greens positioned on opposite sides of the fairway area being positioned in an end-to-end relationship relative to one another.

6. The indoor-outdoor golf game of claim 4 further characterized by the building enclosure having a series of side-by-side stalls, the stalls providing a side-by-side series of the golf ball hitting areas which are completely segregated and protectively encased with respect to one another, thus enabling a group of different foursomes to simultaneously hit golf shots from the golf ball hitting area of each stall to the common fairway area and to the staggered greens so that groups of foursomes can simultaneously play the same course at the same time without interfering with the other play.

7. The indoor-outdoor golf game of claim 4 further characterized by each of the golf ball hitting areas being comprised of artificial turf, the artifical turf being of a varied composition to provide tee, rough, and fairway outdoor grass simulated surfaces, thus enabling the player to strike the ball from a pre-selected turf position on the golf ball hitting area depending on a golfer's golf game situation or shot being either a tee shot, fairway shot, or shot from rough.

8. The indoor-outdoor golf game of claim 4 further characterized by the golf fairway greens being at least five in number with the greens positioned on opposite sides of the fairway area with at least two of the fairway greens being on one side of said fairway area and at least three of the fairway greens being positioned on another side of said fairway area.

9. The indoor-outdoor golf game of claim 4 further characterized by a score card being provided for use by each golfer and having indicia thereon identifying each green and identifying a distance for each of the golf greens from the golf ball hitting area approximately to flags on the greens.

10. In an indoor-outdoor golf game layout comprising a building providing a building enclosure therein, the layout being such as to enable golfers to play a game of golf from inside the building under summer and winter conditions whereby foursomes of golfers can play as a group, a putting area of artificial grass within said building enclosure having putting cups for receiving golf balls, sand trap stalls at opposite ends of the building, end fairway greens facing opposite ends of the building and the sand trap stalls, a series of golf ball hitting stalls positioned between the opposite ends which golf ball hitting stalls each protectively isolate the foursome of golfers therein and with each stall having a golf ball hitting area therein adjacent said putting area, the golf ball hitting areas being comprised of artificial turf, the artificial turf being of a varied composition to provide tee, rough, and fairway outdoor grass simulated surfaces, thus enabling the player to strike the ball from a pre-selected turf position on a golf ball hitting area depending on a golfer's golf game situation or shot being either a tee shot, fairway shot, or a shot from rough; an uncovered outdoor fairway area outside of said building enclosure extending away from said golf ball hitting area, said fairway area being so positioned relative to said golf ball hitting areas in said building enclosure that golf balls may be hit from the stalls from an outer edge of the building enclosure onto said fairway area and from said golf ball hitting areas; and a series of at least five staggered golf fairway greens being located with some of the fairway greens being on each side of said fairway area effectively positioned and extending generally in end-to-end relation along said fairway area in a direction away from said stalls providing a succession of golf green targets at approximate distances of 1 to 275 yards from said hitting areas, fairway traps positioned along the fairway and in adjacency to said fairway greens rough areas for receipt of errant golf balls struck from said golf ball hitting area, thus penalizing the golfer and requiring that the golfer's next shot be played from the rough simulated surface of the hitting area in the associated stall from where the shot was struck, the golfer being required to play his next shot from one of the sand trap stalls should he strike his previous shot into one of said fairway traps and the golfer being required to play his next shot from the putting area should his shot from said golf ball hitting area come to rest on an intended one of said fairway greens.

11. The golf game layout of claim 10 further characterized by the golfers each being provided with a score card having indicia thereon identifying each green and identifying a distance for each of the golf greens from the golf ball hitting area approximately to flags on the greens, the cards having indicia thereon corresponding to golf cards for different well-known golf courses, thus enabling a golfer to play a variety of courses on the indoor-outdoor golf game layout.

12. In an indoor-outdoor golf game layout comprising a building providing a building enclosure therein, a putting area within said building enclosure having putting cups therein for receiving golf balls, at least one golf ball hitting stall positioned at an outer edge of one side of the building enclosure which stall protectively isolates the golfers therein and with the stall having a golf ball hitting area therein adjacent said putting area; an uncovered outdoor fairway area outside of said building enclosure extending away from said golf ball hitting area, said fairway area being so positioned relative to said golf ball hitting area in said building enclosure that golf balls may be hit from an outer edge of the building enclosure onto said fairway area from said golf ball hitting area; and an uninterrupted series of distinct golf fairway greens on opposite sides of said fairway area effectively staggered and positioned substantially in end-to-end coinciding relation along said fairway area collectively providing a succession of golf green targets at approximate distances of 1 to 275 yards from said hitting area, the fairway greens being staggered in random relation on opposite sides of the fairway area extending away from the golf ball hitting area with some of the fairway greens being positioned on one side of the fairway, and with other of the fairway greens being positioned on the other side of the fairway area, but with all of the golf greens positioned generally on opposite sides of the fairway area.

13. The indoor-outdoor golf game of claim 12 further characterized by the building enclosure having a series of side-by-side stalls, the stalls providing a side-by-side series of the golf ball hitting areas which are completely segregated and protectively encased with respect to one another, thus enabling a group of different foursomes to simultaneously hit golf shots from the golf ball hitting area of each stall to the common fairway area and to the end-to-end staggered greens so that groups of foursomes can simultaneously play the same course at the same time without interfering with the other play.

14. The indoor-outdoor golf game of claim 12 further characterized by said putting area having a fringe area for enabling a golfer to play chip golf shots onto the putting area.

15. The indoor-outdoor golf game of claim 12 further characterized by including a series of stalls, the stalls providing a series of the golf ball hitting areas disposed in side-by-side relation and being completely segregated and protectively encased with respect to one another, thus enabling a group of different foursomes to simultaneously hit shots from the golf ball hitting area of each stall to the common fairway area and to the end-to-end staggered greens so that groups of foursomes can simultaneously play the same course at the same time without interfering with the other play.

16. The indoor-outdoor golf game of claim 12 further characterized by each of the golf ball hitting areas being comprised of artificial turf, the artificial turf being of a varied composition to provide tee, rough, and also fairway outdoor grass simulated surfaces thus enabling the player to strike the ball from a pre-selected turf position on the golf ball hitting area depending on a golfer's golf game situation or shot being either a tee shot, fairway shot, or shot from rough.

17. The indoor-outdoor golf game of claim 12 further characterized by air screens cooperating with said golf ball hitting areas at the outer edge of the building enclosure through which the golfer hits his shots, the layout having a series of the stalls, the stalls providing a side-by-side series of the golf ball hitting areas which are completely segregated and protectively encased with respect to one another to protect the golfers from errant shots thus enabling a group of different foursomes to simultaneously hit golf shots from the golf ball hitting area of each stall to the common fairway area and to the end-to-end staggered greens so that groups of foursomes can simultaneously play the same course at the same time without interfering with the other play.

18. The indoor-outdoor golf game of claim 12 further characterized by a score card being provided for use by each golfer and having indicia thereon identifying each green and identifying a distance for each of the golf greens from the golf ball hitting area approximately to flags on the greens.

19. The indoor-outdoor golf game layout of claim 12 further characterized by a series of different types of golf cards being provided for each golfer, the cards having indicia thereon corresponding to golf cards for different well-known golf courses thus enabling a golfer to play a variety of courses on the indoor-outdoor golf game layout.

20. The indoor-outdoor golf game layout of claim 12 further characterized by sand trap stalls located at opposite ends of the building enclosure with said golf ball hitting areas lying between the opposite ends, sand trap areas cooperable with the trap stalls and lying at least in part within the building, separate end located golf greens for receiving sand shots from the sand trap areas at opposite ends of the building, the sand traps being remotely located away from the golf ball hitting area thus enabling golfers to hit shots from the sand traps and the golf ball hitting area at the same time in a safe manner, the layout being such as to enable a golfer to play the same golf sand trap shots playable on a regulation outdoor golf course without leaving the building enclosure.

* * * * *